US005347257A

United States Patent [19]

Biegel

[11] Patent Number: 5,347,257

[45] Date of Patent: Sep. 13, 1994

[54] VARYING INDUCTANCES

[75] Inventor: George E. Biegel, Framingham, Mass.

[73] Assignee: Stocker & Yale, Inc., Beverly, Mass.

[21] Appl. No.: 891,421

[22] Filed: May 29, 1992

Related U.S. Application Data

[63] Continuation-in-part of Ser. No. 484,112, Feb. 23, 1990, Pat. No. 5,140,228.

[51] Int. Cl.[5] ..... H01F 21/06

[52] U.S. Cl. ..... 336/134; 336/135

[58] Field of Search ..... 336/130, 132, 134, 135, 336/136

[56] References Cited

U.S. PATENT DOCUMENTS

| | | | |
|---|---|---|---|
| 2,448,296 | 8/1948 | Cary, Jr. | 171/242 |
| 2,460,656 | 2/1949 | Sliwiak | 171/119 |
| 2,471,222 | 3/1949 | Lorant . | |
| 2,617,092 | 11/1952 | Schlawin | 336/20 |
| 2,823,359 | 2/1958 | Wentworth | 336/135 |
| 2,855,571 | 10/1958 | Kleespies | 333/24 |
| 2,935,707 | 5/1960 | Abbot | 336/135 |
| 3,082,388 | 3/1963 | Hecht et al. | 336/135 |
| 3,243,745 | 3/1966 | Glover et al. | 336/83 |
| 3,289,042 | 11/1966 | Bodenschatz | 317/11 |
| 3,398,386 | 8/1968 | Summerlin | 336/135 |
| 3,423,702 | 1/1969 | Russell | 333/97 |
| 3,753,178 | 8/1973 | Kato | 335/135 |
| 4,551,699 | 11/1985 | de Jong et al. | 336/135 |

FOREIGN PATENT DOCUMENTS

| | | | |
|---|---|---|---|
| 1514133 | 5/1969 | Fed. Rep. of Germany | 336/135 |
| 1564621 | 8/1969 | Fed. Rep. of Germany | 336/135 |
| 2209071 | 8/1973 | Fed. Rep. of Germany | 336/135 |
| 910271 | 1/1946 | France | 336/135 |
| 1081165 | 6/1954 | France | 336/135 |
| 1085135 | 7/1954 | France | 336/135 |
| 1175256 | 11/1958 | France | 336/135 |
| WO91/13530 | 5/1991 | PCT Int'l Appl. | H05B 37/02 |
| 418418 | 2/1967 | Switzerland | 336/135 |
| 442849 | 5/1934 | United Kingdom | 336/135 |
| 417378 | 10/1934 | United Kingdom | 336/135 |

OTHER PUBLICATIONS

Gheorghiu, I. S. et al., "Transformatoare," *Tratat de Masini Electrice, Romania, 1970, pp. 455–457.*

Horowitz, Paul et al., *The Art of Electronics*, New York, 1980, pp. 47–48.

*Primary Examiner*—Thomas J. Kozma

*Attorney, Agent, or Firm*—Fish & Richardson

[57] ABSTRACT

A variable inductor includes at most one coil of electrically conductive material and at most two distinct, separately formed portions of magnetic core material positioned to conduct magnetic flux resulting from passage of electrical current through the coil. At least one of the portions of magnetic core material is located at least partially within a space surrounded by the coil and is movable with respect to the coil. A control device is attached to the movable portion of magnetic core material in a manner such that the movable portion can be moved in its entirety, by manipulating the control device, to change the configuration of a gap within the space surrounded by the coil and defined in part by the movable portion, to vary thereby the inductance of the coil.

9 Claims, 5 Drawing Sheets

VARYING INDUCTANCES

CROSS REFERENCE TO RELATED APPLICATION

This application is a continuation-in-part of copending U.S. patent application Ser. No. 07/484,112, filed on Feb. 23, 1990, now U.S. Pat. No. 5,140,228.

BACKGROUND OF THE INVENTION

This invention relates in general to variable inductors, and in particular to variable inductors suitable for use in regulating the intensity of light emitted by a lamp, especially a fluorescent lamp.

Historically, there has been a need to accurately and efficiently reduce lamp light output or light intensity. When observing an object, the quantity of light is crucial to perceive the desired detail and/or effect. This requirement becomes more acute when a lens system is used in conjunction with the human eye, or other light detector. Cameras, video cameras, CCD detectors, and photo detectors all use lens systems to capture light. The performance of these detectors is affected by any flickering or variation in the intensity of the light. Fluorescent lamps are popular light sources, and use inverter power supplies that drive the lamps at 90 V and 20 khz to produce a steady, predictable illumination. It is desirable to be able to adjust and/or to instantly switch the intensity of the fluorescent lamp between different levels while keeping the illumination steady and predictable.

It is known to vary the intensity of light emitted by a fluorescent lamp by means of a tapped inductor. A switch selectively connects the lamp to one or another of the taps on the tapped inductor, and the intensity of light emitted by the lamp depends on the tap to which the lamp is connected.

Variable inductors are known that include two standard, off-the-shelf cylindrical magnetic core pieces each having a ring-shaped recess into which a respective half of an inductive coil extends, an air gap being located between the two cylindrical magnetic core pieces. These known variable inductors additionally include a third magnetic core piece in the form of a central movable slug of magnetic material, which can be moved axially within a cylindrical bore at the center of the two cylindrical magnetic core pieces, to bridge or open the air gap located between the two cylindrical magnetic core pieces, thereby causing a slight change in inductance.

SUMMARY OF THE INVENTION

In one aspect, the invention features a variable inductor that includes at most one coil of electrically conductive material and at most two distinct, separately formed portions of magnetic core material positioned to conduct magnetic flux resulting from passage of electrical current through the coil. At least one of the portions of magnetic core material is located at least partially within a space surrounded by the coil and is movable with respect to the coil. A control device is attached to the movable portion of magnetic core material in a manner such that the movable portion can be moved in its entirety, by manipulating the control device, to change the configuration of a gap within the space surrounded by the coil and defined in part by the movable portion, to vary thereby the inductance of the coil.

The variable inductor preferably includes only a relatively small number of mechanical components. In particular, variable inductors according to this aspect of the invention have an advantage of not including a specially molded third magnetic core portion.

In another aspect, the invention features a variable inductor that includes a core of magnetic material having a fixed portion and a movable portion, the fixed portion and the movable portion each having a substantially ring-shaped recess, the portions being positioned with the recesses facing each other. A coil is positioned between the portions of the core of magnetic material, and extends into each of the recesses. The movable portion can be moved with respect to the fixed portion by manipulating a control device to change the configuration of a gap between the fixed portion and the movable portion.

Preferred embodiments of this aspect of the invention include only standard, off-the-shelf magnetic core portions, thereby eliminating any need for specially molded core portions. Thus, this aspect of the invention provides a simple, cost-effective construction that can be used to vary inductance over a wide range of values.

Numerous other features, objects, and advantages of the invention will become apparent from the following detailed description when read in connection with the accompanying drawings.

DETAILED DESCRIPTION

Figure 1:
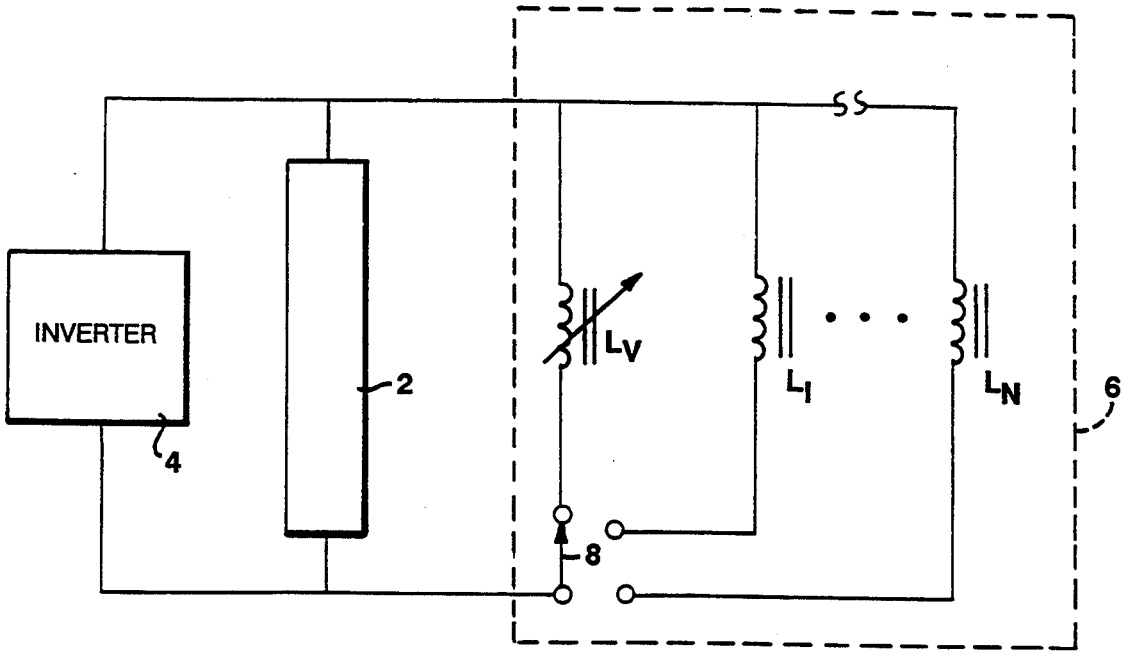
FIG. 1 is a circuit diagram of a circuit for regulating the intensity of light emitted by a lamp.

Referring to FIG. 1, power is supplied to a fluorescent lamp 2 from an appropriate power source (not shown) through a standard inverter 4 connected in parallel to lamp 2. The intensity of the light emitted from lamp 2 is regulated by a control circuit 6 that includes a variable inductor $L_v$ and a plurality of standard fixed inductors $L_1$–$L_N$. A switch 8 is adjustable to connect one of the inductors to lamp 2 in parallel. A complete lighting fixture includes other standard components (filters, etc.) well known to those skilled in the art and therefore not shown in FIG. 1.

Figure 2:
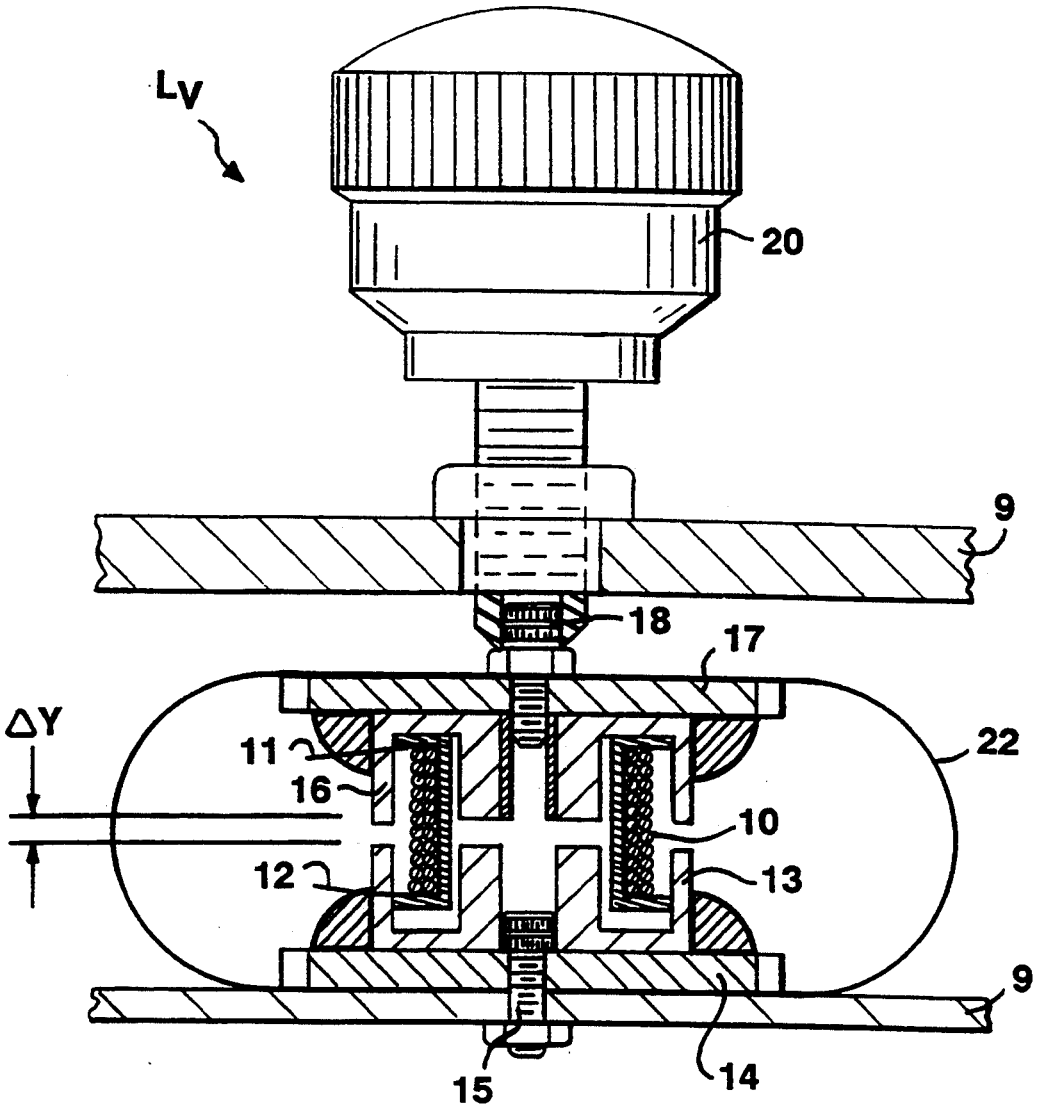
FIG. 2 is a drawing, in partial cross-section, of a variable inductor suitable for use in the circuit illustrated in FIG. 1.

Referring to FIG. 2, variable inductor $L_v$ is shown in more detail. Inductor $L_v$ is supported in a housing 9 and includes a coil 10 having leads 11, 12. Immediately beneath coil 10 is a ferrite core 13, which is secured to the lower part of housing 9 through a base 14 and a screw 15. The upper portion of coil 10 is attached to a second, movable ferrite core 16 which is positioned above ferrite core 13 with a gap $\Delta Y$ therebetween. Movable ferrite core 16 is attached at its upper end to a movable base 17. A screw 18 is secured to movable base 17, with the head of the screw positioned within a recess in the bottom of a thumbscrew 20. Thumbscrew 20 is manually rotatable through a bore in housing 9. A spring 22 surrounds bases 14 and 17 and exerts a force that pulls bases 14 and 17 away from each other. Therefore, when thumbscrew 20 is rotated to move it away from housing 9, the head of screw 18 remains within the recess due to the force of spring 22. Ferrite core 16 will therefore also be raised which will increase $\Delta Y$, and decrease the inductance measured across leads 11, 12. Conversely, rotating thumbscrew 20 in the opposite direction will reduce $\Delta Y$ and result in an increase in inductance.

In operation, a user selects either variable inductor $L_v$ or one of fixed inductors $L_1$–$L_N$ using switch 8. If inductor $L_v$ is chosen, the intensity of the light emitted by lamp 2 can be varied by varying the inductance of inductor $L_v$ through rotation of thumbscrew 20. Fixed inductors $L_1$–$L_N$ have different inductances, each of which corresponds to a different desired intensity of the light emitted by lamp 2. For example, $L_1$ can be chosen so that the light emitted by lamp 2 will be reduced by 20% when switch 8 is adjusted to connect $L_1$ to lamp 2. Similarly, $L_2$ can be chosen to reduce the light emitted by lamp 2 by 40%, etc. Accordingly, a user can either choose $L_v$ and manually adjust the light intensity to a desired level, or can choose a fixed inductor which sets the light intensity at a predetermined level. Switch 8 can also be left in an open position which will effectively remove all of the inductors from the circuit causing lamp 2 to emit light at its normal or maximum intensity.

Figure 3:
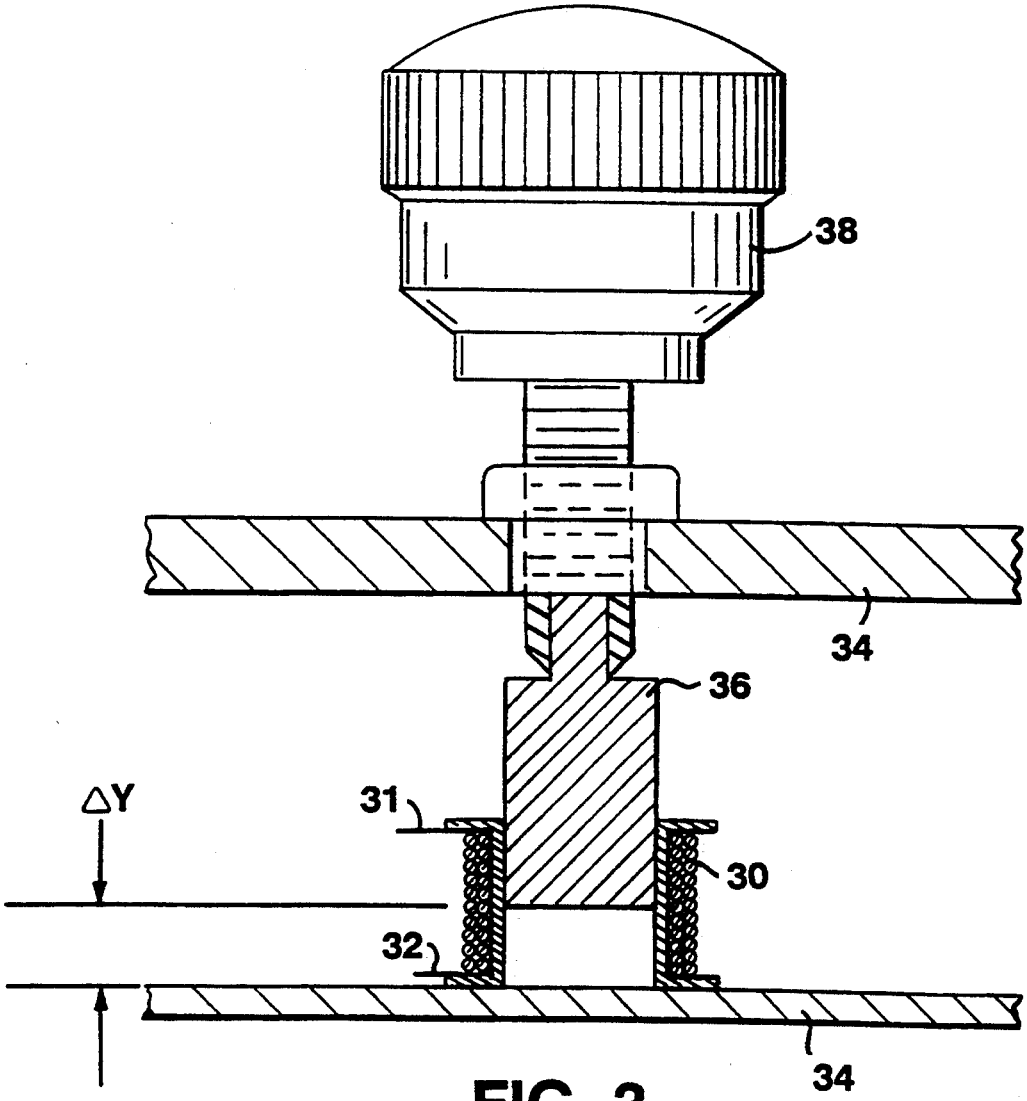
FIG. 3 is a drawing, in partial cross-section, of another variable inductor suitable for use in the circuit illustrated in FIG. 1.

FIG. 3 shows an alternate embodiment of variable inductor $L_v$. In this embodiment, a coil 30, having leads 31, 32, is attached to housing 34. A ferrite core 36, attached to a thumbscrew 38, can be raised and lowered into the center of coil 30. The amount of core 36 within coil 30 is represented by $\Delta Y$. As ferrite core 36 is lowered into the center of coil 30, $\Delta Y$ decreases and the inductance measured across leads 31, 32 will increase. Conversely, the inductance can be reduced by raising ferrite core 36 and increasing $\Delta Y$.

Figure 4:
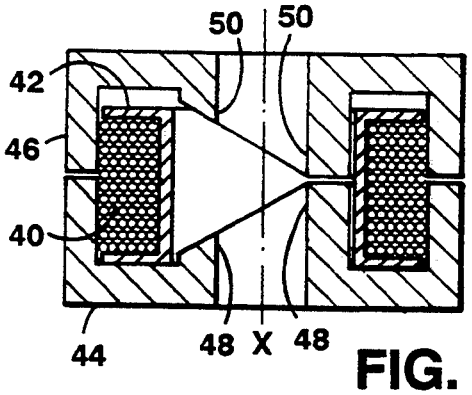
FIG. 4 is a cross-sectional drawing of the coil and magnetic core portions of yet another variable inductor suitable for use in the circuit illustrated in FIG. 1, the magnetic core portions being shown in the maximum inductance position.
Figure 4A:
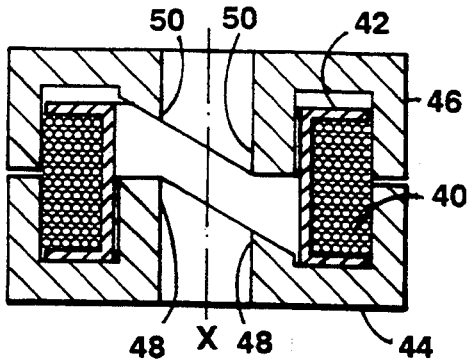
FIG. 4A is a cross-sectional drawing of the coil and magnetic core portions shown in FIG. 4, with the magnetic core portions in the minimum inductance position.
Figure 4B:
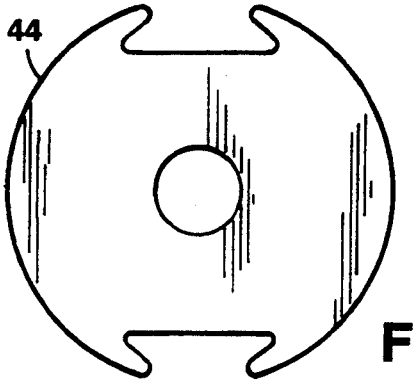
FIG. 4B is an axial view of one of the magnetic core portions shown in FIGS. 4 and 4A.
Figure 4C:
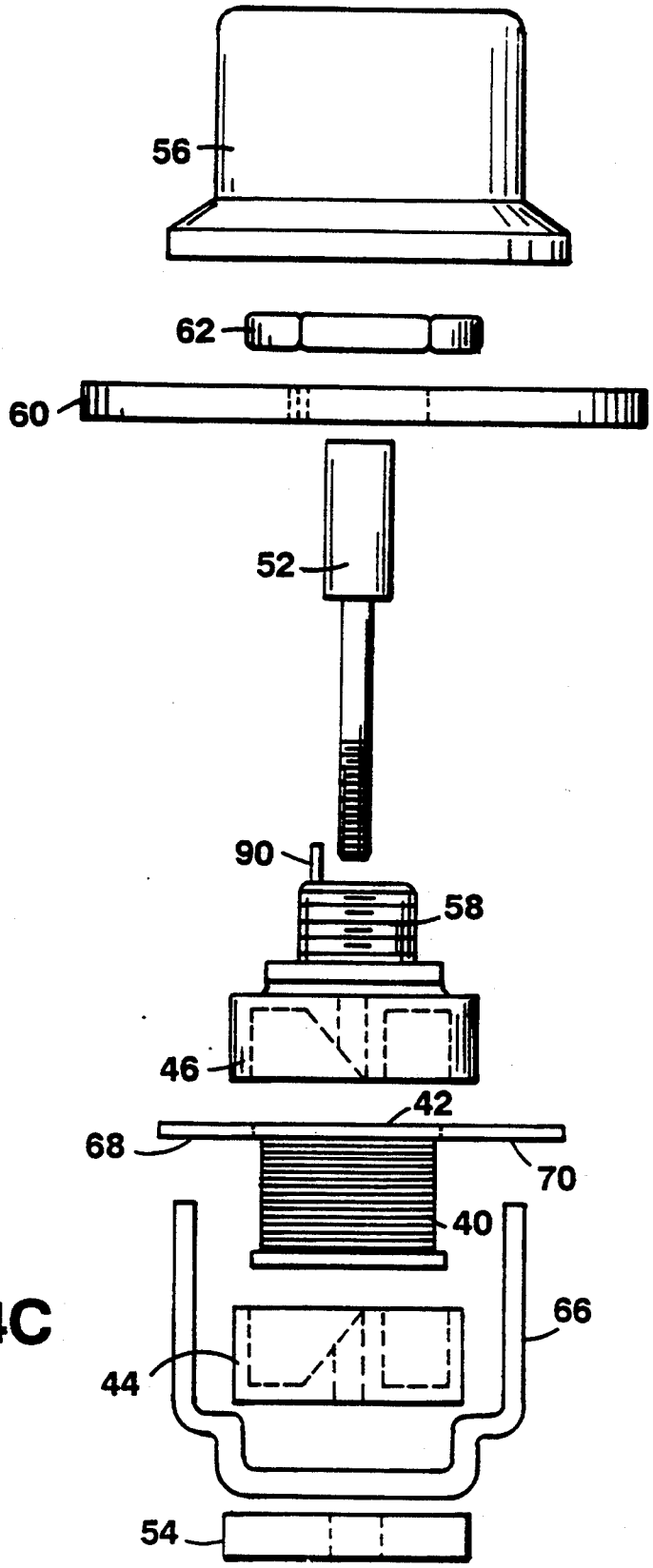
FIG. 4C is an exploded view of the various components of a variable inductor including the coil and magnetic coil portions shown in FIGS. 4, 4A, and 4B.

FIGS. 4 through 4C show another embodiment of a variable inductor suitable for use in the circuit of FIG. 1. Coil 40, supported on plastic bobbin 42, is positioned between a lower, rotatable ferrite core portion 44 and an upper, stationary ferrite core portion 46, bobbin 42 and coil 40 remaining stationary as ferrite core portion 44 is rotated. Ferrite core portions 44 and 46 are standard, off-the-shelf components (similar in construction to ferrite core portions 13 and 16 shown in FIG. 2) having ring-shaped recesses within which coil 40 is placed and having central cylindrical bosses 48 and 50 that provide a path for the conduction of magnetic flux through the center of coil 40, the only modification to these off-the-shelf components being the presence of identical slanted cuts through central cylindrical bosses 48 and 50. The slanted cuts in central cylindrical bosses 48 and 50 permit the inductance of the variable inductor to be varied by simply rotating lower ferrite core portion 44 with respect to upper ferrite core portion 46. Because the inductance of the variable inductor is a function of the ability of magnetic flux to pass through the center of coil 40, which is in turn a function of the shortest distance between central bosses 48 and 50, the maximum inductance position is achieved when ferrite core portion 44 is positioned as shown in FIG. 4 and the minimum inductance position is achieved when ferrite core portion 44 is rotated about axis X to the position shown in FIG. 4A.

Ferrite core portions 44 and 46 each have a central hole through which shaft 52 passes. Shaft 52 is epoxied to cylindrical back plate 54, which is in turn epoxied to ferrite core portion 44, so that rotation of shaft 52 by means of knob 56 causes ferrite core portion 44 to rotate. Stationary ferrite core portion 46 is epoxied to threaded cylindrical bushing 58, which is attached to stationary face plate 60 by nut 62 and which further includes a locking pin 90 that engages face plate 60 to ensure that cylindrical bushing 58 and ferrite core portion 46 can not rotate with respect to face plate 60.

Ferrite core portions 44 and 46 each contain a pair of openings in their outer circumferential walls, which are present in the ferrite core portions as sold off-the-shelf, the locations of these openings being visible in the axial view of ferrite core portion 44 shown in FIG. 4B. The openings in rotating ferrite core portion 44 engage a thin bracket 66, whereas the openings in ferrite core portion 46 engage thin plastic bobbin extensions 68 and 70 on which electrical leads to coil 40 are mounted. Plastic bobbin extensions 68 and 70 contact bracket 66 when ferrite core portion 44 is rotated all the way to the maximum inductance position or the minimum inductance position, and thereby prevent rotation of ferrite core portion 44 beyond these points.

The embodiment shown in FIGS. 4 through 4C, in which one of the ferrite core portions is rotated but not moved axially, is less expensive, easier to build, more stable, and requires fewer components than the embodiment shown in FIG. 2, which uses similar ferrite core portions but which requires a combination of rotation and axial movement of one of the ferrite core portions and which requires certain components, such as a special housing 9 and a spring 22, that are not needed in the embodiment of FIGS. 4 through 4C. The embodiment shown in FIG. 2 provides finer adjustment than the embodiment shown in FIG. 4 because knob 20 in FIG. 2 is rotated two full times between the minimum inductance position and the maximum inductance position whereas knob 56 is rotated only one-half turn. On the other hand, the half-turn range of the embodiment shown in FIGS. 4 through 4C is in some respects more convenient to use.

Variants of the embodiment shown in FIGS. 4 through 4C can be achieved by modifying the cuts in central cylindrical bosses 48 and 50. For example, bosses 48 and 50 could be cut in a manner such that it would be necessary to rotate one of the ferrite core portions by nearly 360 degrees to vary inductance from a minimum value to a maximum value.

Figure 5:
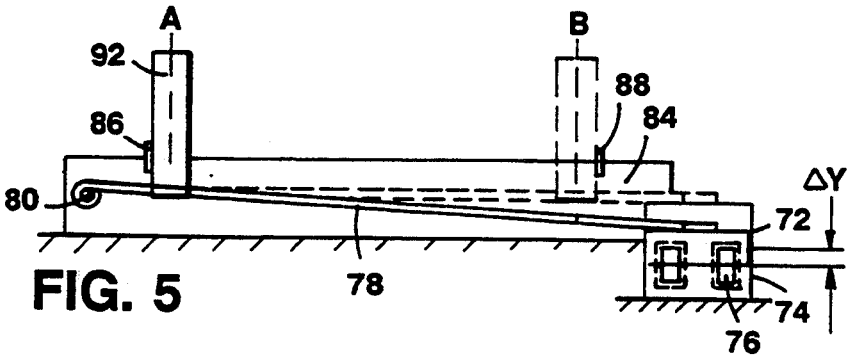
FIG. 5 is a side view of another variable inductor suitable for use in the circuit illustrated in FIG. 1.
Figure 5A:
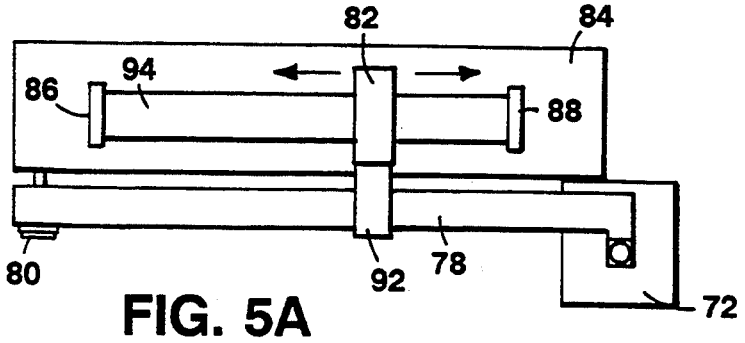
FIG. 5A is a top view of the variable inductor shown in FIG. 5.

FIGS. 5 and 5A show another embodiment of a variable inductor suitable for use in the circuit of FIG. 1. In this embodiment upper ferrite core portion 72 is moved axially with respect to lower ferrite core portion 74 and coil 76 to vary inductance (ferrite core portions 74 and 76 being similar in construction to ferrite core portions 13 and 16 shown in FIG. 2 except that ferrite core portions 74 and 76 are square-shaped and have recesses in the form of square-shaped rings rather than circular rings). The solid lines in FIG. 5 show the locations of the various components when ferrite core portion 72 is in its lowest position (the maximum inductance position), and the dashed lines show the locations of components when ferrite core portion 72 is in its highest position (minimum inductance position), creating a gap $\Delta Y$ between ferrite core portions 72 and 74.

Ferrite core portion 72 is raised and lowered by lever 78, which pivots about fixed pivot 80. The position of lever 78 is controlled by an actuator that slides in slot 94 of slide mechanism 84, the actuator consisting of a slidable knob 82 (which resembles the sliding knobs found on many sound equalizers for stereo systems) and an attached arm 92 that slidably engages lever 78. The angular position of lever 78 can be adjusted by positioning slidable knob 82 anywhere between maximum inductance position A and minimum inductance position B on slide mechanism 84. A pair of stops 86 and 88 are provided on slide mechanism 84 to prevent movement of slidable knob 82 beyond positions A and B. It is believed that some persons may find this construction more convenient to use or cosmetically appealing than a rotatable knob.

There has been described novel and improved apparatus and techniques for varying inductances. It is evident that those skilled in the art may now make numerous uses and modifications of and departures from the specific embodiment described herein without departing from the inventive concept. Consequently, the invention is to be construed as embracing each and every novel feature and novel combination of features present in or possessed by the apparatus and technique herein disclosed and limited solely by the spirit and scope of the appended claims.

What is claimed is:

1. A variable inductor comprising:

a coil of electrically conductive material, said coil being supported on a bobbin having a plurality of extensions protruding therefrom on which a plurality of electrical leads to said coil are mounted;

two distinct, separately formed portions of magnetic core material positioned to conduct magnetic flux resulting from passage of electrical current through said coil, one of said portions of magnetic core material being movable, the other of said portions of magnetic core material being fixed, said fixed portion and said movable portion each having a substantially ring-shaped recess, said portions being positioned with said recesses facing each other, said coil being positioned between said portions of magnetic core material, and extending into each of said recesses, each of said portions of magnetic core material comprising a central boss occupying a space surrounded by said coil;

a control device attached to said movable portion of magnetic core material in a manner such that said movable portion can be rotated in its entirety with respect to said fixed portion, by manipulating said control device, to change the configuration of a gap located between said fixed portion and said movable portion within said space surrounded by said coil, said control device being manually rotatable and being attached to said movable portion of magnetic core material in a manner such that said movable portion rotates in conjunction with said control device; and a bracket constructed in a manner such that said bracket remains in a fixed position with respect to one of said portions of magnetic core material as said movable portion of magnetic core material is rotated with respect to said fixed portion;

each of said portions of magnetic core material having an outer wall comprising a plurality of openings, the openings in the outer wall of said one of said portions of magnetic core material engaging said bracket to ensure that said bracket remains in a fixed position with respect to said openings of said one of said portions of magnetic core material, the openings in the outer wall of the other portion of magnetic core material engaging said extensions of said bobbin to ensure that said extensions of said bobbin remain in a fixed position with respect to said openings of said other portion of magnetic core material, said openings in said outer wall of said other portion of magnetic core material also providing conduits for leads connected to said coil;

said bracket being constructed to contact said extensions of said bobbin when said movable portion of magnetic core material is rotated with respect to said fixed portion of magnetic core material to a maximum inductance position and when said movable portion is rotated to a minimum inductance position, said bracket thereby preventing further rotation of said movable portion with respect to said fixed portion beyond said maximum and minimum inductance positions at which said stop contacts said bracket.

2. The variable inductor of claim 1, wherein said two distinct, separately formed portions of magnetic core material are comprised of ferrite.

3. A variable inductor comprising:

a core of magnetic material comprising a fixed portion and a movable portion, said fixed portion and said movable portion each having a substantially ring-shaped recess, said portions being positioned with said recesses facing each other;

a coil positioned between said portions of said core of magnetic material, and extending into each of said recesses, said coil being supported on a bobbin having a plurality of extensions protruding therefrom on which a plurality of electrical leads to said coil are mounted, each of said portions of said core comprising a central boss occupying a space surrounded by said coil; and a control device attached to said movable portion in a manner such that said movable portion can be rotated with respect to said fixed portion by manipulating said control device to change the configuration of a gap between said fixed portion and said movable portion, to vary thereby the inductance of said coil, said control device being manually rotatable and being attached to said movable portion of said core in a manner such that said movable portion rotates in conjunction with said control device; and a bracket constructed in a manner such that said bracket remains in a fixed position with respect to one of said portions of said core as said movable portion of said core is rotated with respect to said fixed portion;

each of said portions of said core having an outer wall comprising a plurality of openings, the openings in the outer wall of said one of said portions of said core engaging said bracket to ensure that said bracket remains in a fixed position with respect to said openings of said one of said portions of said core, the openings in the outer wall of the other portion of said core engaging said extensions of said bobbin to ensure that said extensions of said bobbin remain in a fixed position with respect to said openings of said other portion of said core, said openings in said outer wall of said other portion of said core also providing conduits for leads connected to said coil;

said bracket being constructed to contact said extensions of said bobbin when said movable portion of said core is rotated with respect to said fixed portion of said core to a maximum inductance position and when said movable portion is rotated to a minimum inductance position, said bracket thereby preventing further rotation of said movable portion with respect to said fixed portion beyond said maximum and minimum inductance positions at which said stop contacts said bracket.

4. The variable inductor of claim 3, wherein said fixed portion and said movable portion of said core of magnetic material are comprised of ferrite.

5. The variable inductor of claim 3, wherein said fixed portion and said movable portion have identical constructions.

6. The variable inductor of claim 3, wherein said control device is manually rotatable through a bore in a stationary structure.

7. The variable inductor of claim 3, wherein said control device is constructed in a manner such that the axial position of said movable portion of said core with respect to said fixed portion remains constant as said movable portion is rotated with respect to said fixed portion.

8. The variable inductor f claim 3, wherein each of said central bosses of said movable and fixed portions of said core has a surface that is slanted with respect to a plane passing through an interface between said movable and fixed portions of said core.

9. The variable inductor of claim 8, wherein said slanted surfaces of said central bosses are configured in a manner such that rotation of said movable portion of said core through approximately 180 degrees with respect to said fixed portion causes a shortest distance between said central bosses to vary between a minimum value and a maximum value.

* * * * *